US007069987B2

(12) United States Patent
Kwasniewski et al.

(10) Patent No.: US 7,069,987 B2
(45) Date of Patent: Jul. 4, 2006

(54) CASING ADAPTER TOOL FOR WELL SERVICING

(75) Inventors: Nathan Kwasniewski, Sherwood Park (CA); Keith David Farquharson, Edmonton (CA); Bob McGuire, Oklahoma City, OK (US); John Henry Whelan, The Woodlands, TX (US)

(73) Assignee: Stream-Flo Industries, Ltd., Edmonton (CA)

( * ) Notice: Subject to any disclaimer, the term of this patent is extended or adjusted under 35 U.S.C. 154(b) by 196 days.

(21) Appl. No.: 10/774,072

(22) Filed: Feb. 6, 2004

(65) Prior Publication Data

US 2004/0173348 A1 Sep. 9, 2004

Related U.S. Application Data

(60) Provisional application No. 60/445,617, filed on Feb. 7, 2003.

(51) Int. Cl.
*E21B 33/03* (2006.01)

(52) U.S. Cl. ..... 166/85.3; 166/86.3

(58) Field of Classification Search ..... 166/85.3, 166/88.2, 88.3, 86.3
See application file for complete search history.

(56) References Cited

U.S. PATENT DOCUMENTS

| | | | | |
|---|---|---|---|---|
| 2,233,077 | A * | 2/1941 | Gillespie et al. | 166/67 |
| 2,617,485 | A * | 11/1952 | Thatch | 277/328 |
| 3,255,823 | A * | 6/1966 | Barton | 166/85.1 |
| 5,819,851 | A | 10/1998 | Dallas | 166/308 |
| 6,247,537 | B1 | 6/2001 | Dallas | 166/379 |
| 6,364,024 | B1 | 4/2002 | Dallas | 166/379 |
| 6,491,098 | B1 | 12/2002 | Dallas | 166/297 |
| 6,675,900 | B1 * | 1/2004 | Baskett et al. | 166/379 |

FOREIGN PATENT DOCUMENTS

| | | |
|---|---|---|
| CA | 2276973 | 7/1999 |

* cited by examiner

*Primary Examiner*—William Neuder
(74) *Attorney, Agent, or Firm*—Greenlee, Winner and Sullivan, P.C.

(57) ABSTRACT

The invention provides a casing adapter tool which connects and seals to a casing pipe at its lower end and to production or service equipment at its upper end, and is used with well servicing equipment, such as is involved in fracturing. The casing adapter tool includes a generally tubular casing adapter body having an upper end and a lower end, and is formed with a central bore extending therethrough. The central bore provides a profile which forms a casing seal chamber at the lower end, and a barrier seal chamber located thereabove. The barrier seal chamber is formed with a profile to accommodate and seal to a first removable pressure barrier on removal of any well servicing equipment. Most preferably, the barrier seal chamber has a profile sized to provide full bore access to the casing pipe and to accommodate and seal to the first removable pressure barrier which is of a threaded, latched or snap ring type check valve or plug. The casing adapter body may also form a fracturing seal chamber in the central bore above or below the barrier seal chamber, with a profile to permit a fracturing isolation tool to be run in and sealed against the central bore. The casing adapter tool preferably includes a tubing hanger portion at its upper end, such that the tubing hanger can provide a second barrier, such as a check valve. The casing adapter tool thus provides a quick connection, seals and full bore access to the casing pipe. Once all well servicing equipment is removed, the casing adapter tool remains on the well and provides at least one and preferably two independent barriers between the well bore pressure and the atmosphere.

5 Claims, 12 Drawing Sheets

CASING ADAPTER TOOL FOR WELL SERVICING

CROSS-REFERENCE TO RELATED APPLICATIONS

This application claims priority to U.S. Provisional Application No. 60/445,617 filed Feb. 7, 2003, which is incorporated herein in its entirety to the extent not inconsistent herewith.

FIELD OF THE INVENTION

This invention relates to a casing adapter tool for well servicing.

BACKGROUND OF THE INVENTION

One frequent well servicing technique for oil and gas formation having low permeability is to artificially "stimulate" to increase the permeability of the production zone(s). Generally, these stimulation techniques are referred to as "fracturing." Fracturing involves pumping pressurized fluids through perforations in a well casing into a production zone in order to break or fracture pores in the production zone into the casing. Fracturing generally involves first using a tool known as a perforating gun to perforate the production zone adjacent the casing. Thereafter, fracturing fluids are pumped under very high pressures of about 5,000–10,000 psi through the perforations into the formation. The high pressure breaks the formation to form a flow channel for hydrocarbon fluids. Proppants are also injected to prevent the formation from collapsing after the high stimulation pressure is released.

During fracturing, isolation tools are needed to isolate the wellhead from the high pressures of fracturing. In the prior art, these fracturing isolation tools generally seal inside the casing or on the bit guide in a manner which can restrict full bore access to the casing. Full bore access is particularly desirable for fracturing techniques which involve fracturing in stages. After fracturing, the fracturing isolation tool is removed. At this point, since the well may be live, it is necessary to maintain control over the well. One prior art approach is to install a bridge plug, which seals inside the casing. These tools are expensive to rent and to use. Another approach is to control the well pressure with a column of mud or water. However, this procedure can damage the formation. Both of the above approaches require a service crew at the well, which is time and resource intensive.

SUMMARY OF THE INVENTION

There remains a need for a wellhead tool which will seal directly to the casing without restricting access to the bore, allowing well servicing equipment such as a fracturing isolation tool to be run in and removed through the tool, and which can be thereafter plugged to maintain well control when the well servicing equipment is removed, without the need to remove the wellhead tool. Seals to the servicing equipment, such as to the fracturing isolation tool, may optionally be provided in the tool itself. The present invention provides such a wellhead tool in the form of a casing adapter tool.

The casing adapter tool provides a quick connection and optionally for seals, for well servicing tools such as fracturing equipment. Once the fracturing is completed and all well servicing equipment is removed, the casing adapter tool remains on the well and provides for the installation of at least one and preferably two independent pressure barriers, such as check valves or plugs, between the well bore pressure and the atmosphere.

Broadly stated, the casing adapter tool of the present invention connects and seals to a casing pipe at its lower end and to production or service equipment at its upper end, and is used with a well servicing equipment, such as involved in fracturing. The casing adapter tool includes a generally tubular casing adapter body having an upper end and a lower end, and is formed with a central bore extending therethrough. The central bore provides a profile which forms a casing seal chamber at the lower end, and a barrier seal chamber located thereabove. The barrier seal chamber is formed with a profile to accommodate and seal to a first removable pressure barrier on removal of any well servicing equipment. The casing adapter tool includes lower connectors at the lower end of the casing adapter body for connecting and sealing to the casing pipe, and top connectors at the upper end of the casing adapter body for connecting and sealing to production or service equipment.

Most preferably, the barrier seal chamber has a profile sized to provide full bore access to the casing pipe and to accommodate and seal to the first removable pressure barrier which is of a threaded, latched or snap ring type check valve or plug.

The casing adapter tool preferably also provides for a fracturing seal chamber in the central bore above or below the barrier seal chamber, said fracturing seal chamber having a profile to permit a fracturing isolation tool to be run in and sealed against the central bore The casing adapter tool preferably includes an integral tubing head portion at its upper end, formed with a central bore which communicates with the central bore of the casing adapter so as to permit a fracture tool to be run therethrough. The central bore in the tubing head portion forms a tubing hanger chamber for sealing relationship with a tubing hanger which provides for installation of a second pressure barrier.

In multiple embodiments of the casing adapter tool, the bottom connectors to the casing pipe may include a slip lock connector, a welded connection, a threaded connection or a flange connection. The casing adapter body may include an inwardly extending stop shoulder formed at the top of the casing seal chamber in the central bore to protect the top of the casing pipe. The top connectors to the production or service equipment may include a threaded, flange or clamp connection.

By the term "full bore access", as used herein and in the claims, is meant a diameter which is equal to or greater than the drift diameter of the casing pipe.

By the term "pressure barrier", as used herein and in the claims, is meant a check valve or plug which protects equipment and devices located thereabove against downhole pressure.

BRIEF DESCRIPTION OF THE DRAWINGS

FIG. 5 is a side, sectional view of the casing adapter tool of FIG. 1, showing a back pressure valve in place above the connection to the casing, and a tubing hanger in place with a second back pressure valve in the upper portion of the casing adapter tool;

FIG. 6 is side sectional view of an alternate embodiment of the casing adapter tool of FIG. 1, including a single back pressure valve above the connection to the casing, and a flange connection at its upper end for connection to production or service equipment; and FIG. 7 is a side sectional view of an alternate embodiment of the casing adapter of FIG. 1, including a single back pressure valve above the connection to the casing, and a threaded connection at its upper end for connection to production or service equipment.

FIG. 8 is a side sectional view of an alternate embodiment of the casing adapter of FIG. 1, including a welded connection to the casing, a back pressure valve in place above the connection to the casing, and the tubing hanger in place with a second back pressure valve in the upper portion of the casing adapter;

FIG. 9 is a side sectional view of an alternative embodiment of the casing adapter of FIG. 1, including a welded connection to the casing, a single back pressure valve above the connection to the casing and a flange connection at its upper end for connection to production equipment; and FIG. 10 is a side sectional view of an alternative embodiment of the casing adapter of FIG. 1, including a welded connection to the casing, a single back pressure valve above the connection to the casing, and a threaded connection at its upper end for connection to production equipment.

FIG. 11 is a side sectional view of an alternative embodiment of the casing adapter of FIG. 1, showing a back pressure valve in place above a flange connection to the casing, and a tubing hanger in place with a second back pressure valve;

FIG. 12 is a side sectional view of an alternative embodiment of the casing adapter of FIG. 1, showing a single back pressure valve in place above a flange connection to the casing and flange connection at its upper end for connection to production equipment;

FIG. 13 is a side sectional view of an alternative embodiment of the casing adapter of FIG. 1, showing a single back pressure valve above a flange connection to the casing and a threaded connection at its upper end for connection to production equipment.

FIG. 14 is a side sectional view of an alternative embodiment of the casing adapter of FIG. 1, showing a back pressure valve in place above a threaded connection to the casing, and a tubing hanger in place with a second back pressure valve;

FIG. 15 is a side sectional view of an alternative embodiment of the casing adapter of FIG. 1, showing a single back pressure valve in place above a threaded connection to the casing and flange connection at its upper end for connection to production equipment; and FIG. 16 is a side sectional view of an alternative embodiment of the casing adapter of FIG. 1, showing a single back pressure valve above a threaded connection to the casing and a threaded connection at its upper end for connection to production equipment.

DESCRIPTION OF THE PREFERRED EMBODIMENTS

FIGS. 1–5 show a preferred embodiment of the casing adapter 10 of this invention which can accommodate two pressure barriers such as back pressure valves, while FIGS. 6–16 show alternate embodiments which might accommodate one or more pressure barriers such as a back pressure valves, and include alternate top and bottom connectors respectively for connecting to production or service equipment (not shown) and to the upper or stub end of the casing pipe 12. The Figures show the casing adapter 10 in embodiments useful for use with a fracturing isolation tool, but the adapter 10 may be modified for use with other well servicing equipment.

Figure 1:
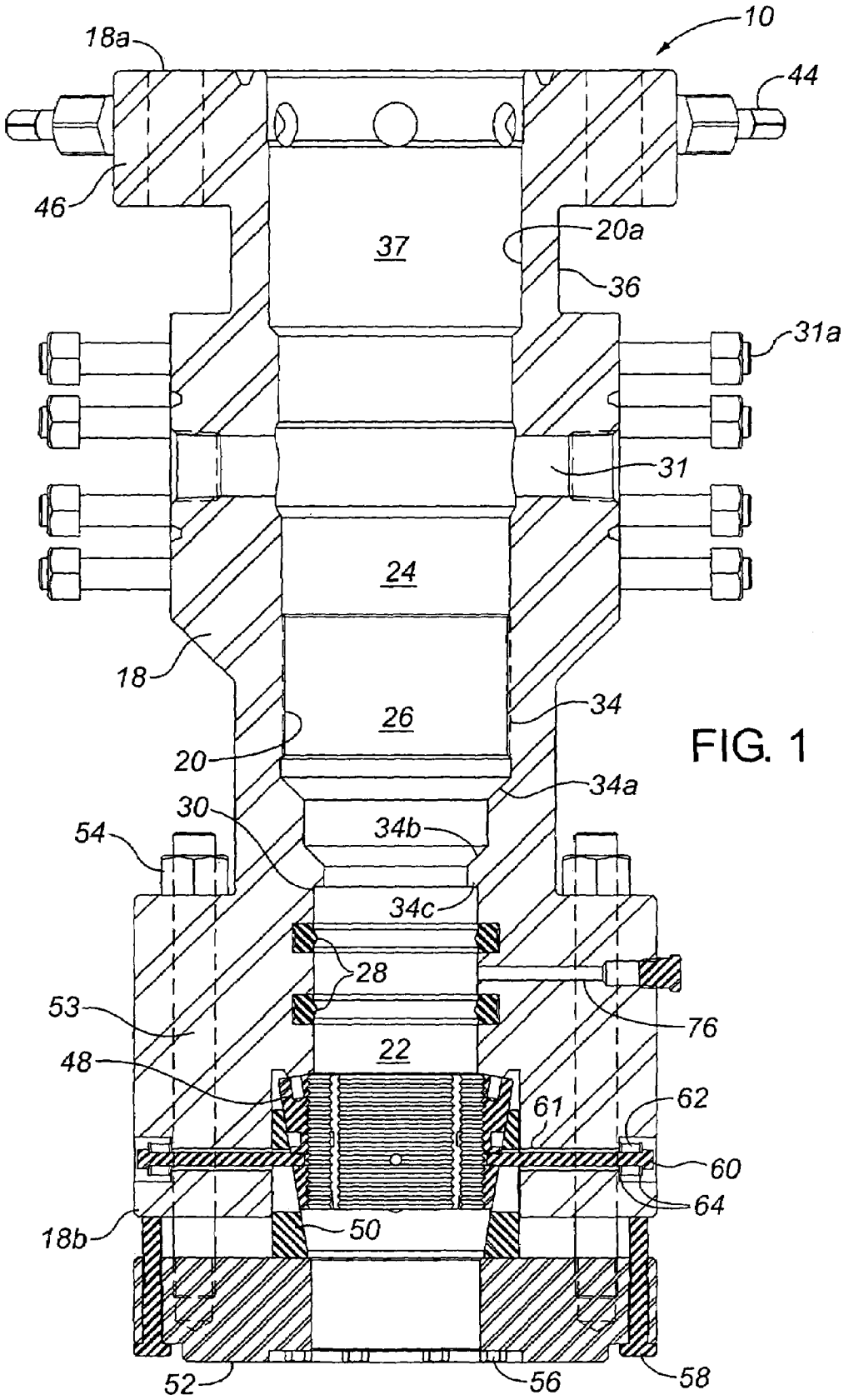
FIG. 1 is a side sectional view of the casing adapter tool of the present invention, prior to installation on the casing, showing slip lock connections at its bottom end for connecting to the casing, and a flange connection at its upper end for connection to the production equipment or service equipment. Alternate embodiments of the tool's top and bottom connectors are shown in FIGS. 6–16.
Figure 5:
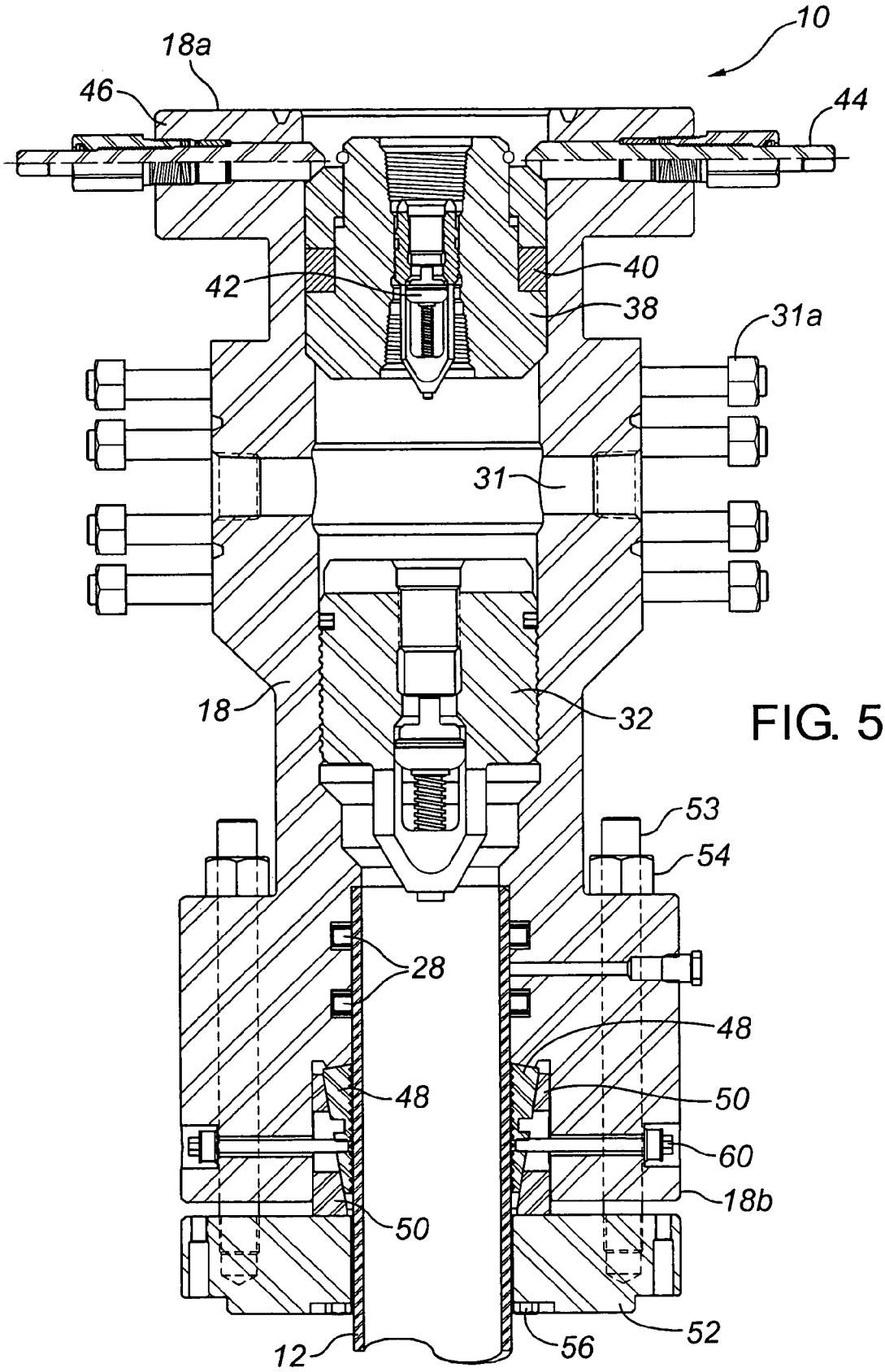
FIGS. 5, 6 and 7 all include slip lock connections at the lower end of the casing adapter to the casing, and are as follows.
Figure 6:
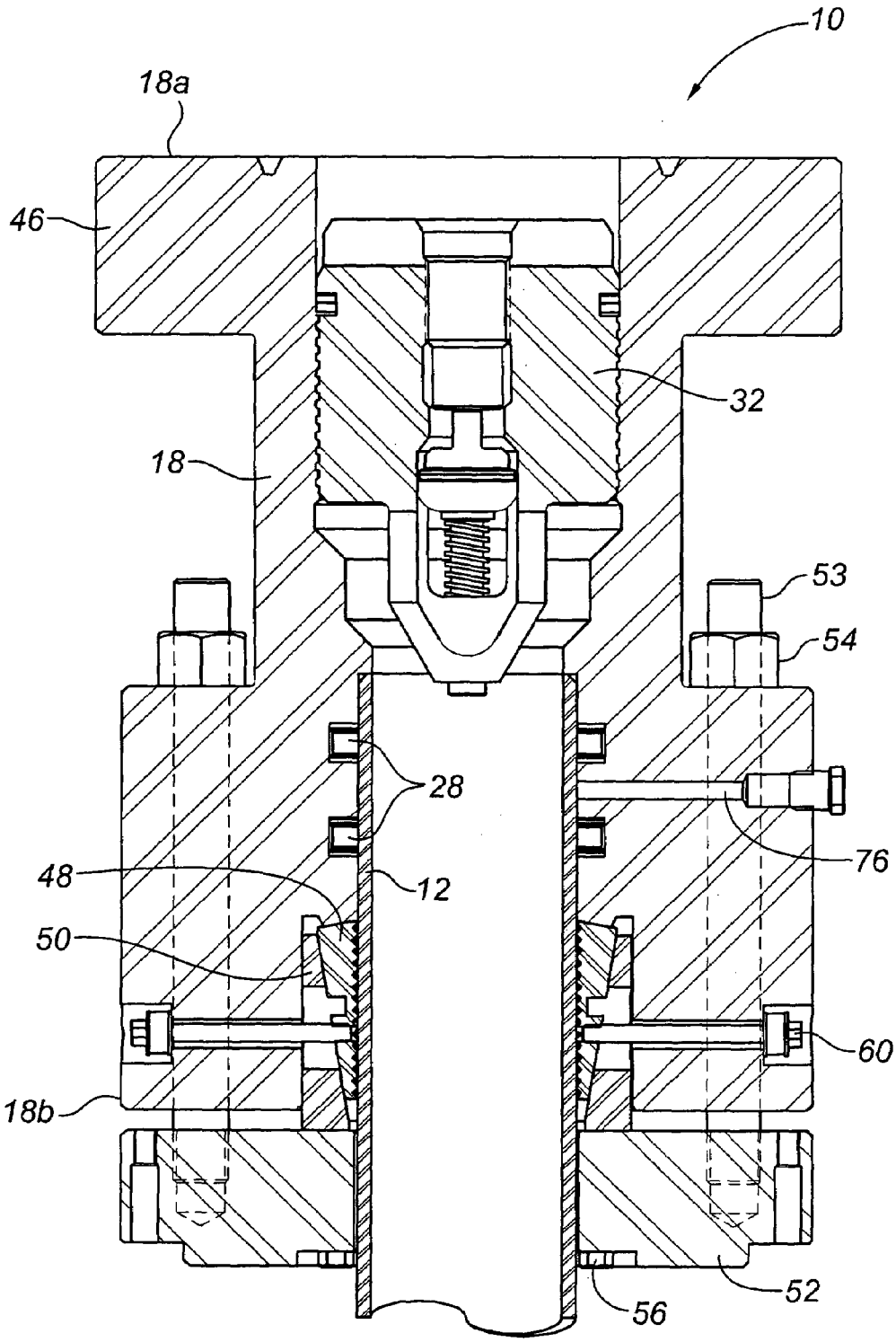
Figure 7:
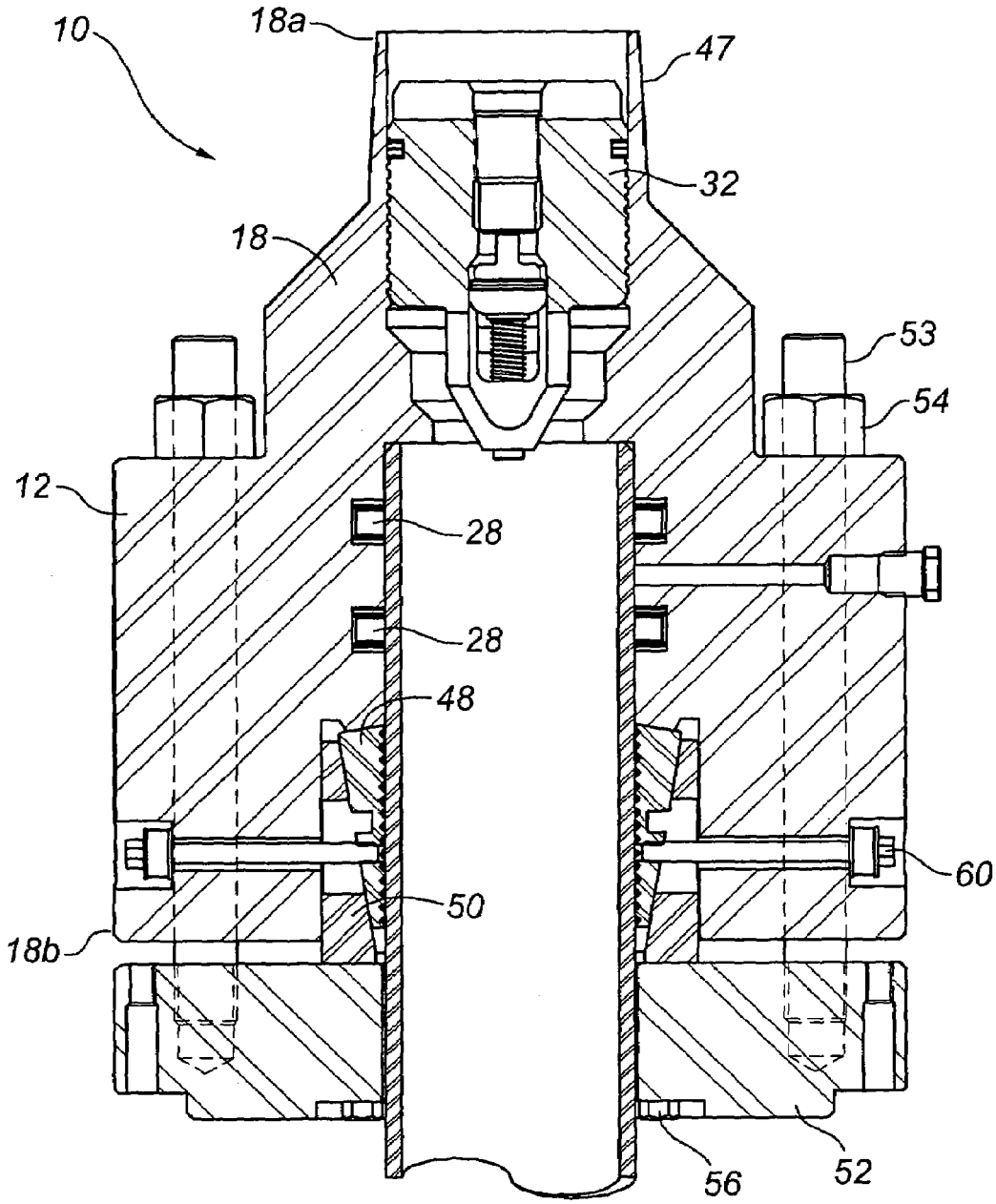

FIGS. 1 and 5 shows the casing adapter 10 to include a tubular casing adapter body 18, having an upper end 18*a* and a lower end 18*b*, with a central bore 20 extending therethrough. The profile of the central bore 20 provides a casing seal chamber 22 at its lower end, a barrier seal chamber 26 above the casing seal chamber 22, and an optional fracturing seal chamber 24 located either above or below the barrier seal chamber 26. In FIG. 1, the fracturing seal chamber 24 is shown above the barrier seal chamber 26. The casing seal chamber 22 is sized to accommodate the upper end or stub of a casing pipe 12 in sealing relationship, such that seals 28 in the wall of the casing seal chamber 22 seal against the outer wall of the casing pipe 12. The seals 28 provide high pressure sealing capability to withstand the high pressures of fracturing, such as 5,000 to 10,000 psi. Exemplary seals are plastic injection seals, described below, but other known seals may be used. An inwardly extending casing stop shoulder 30 is preferably formed at the top of the casing seal chamber 22 to protect the top of the casing pipe 12.

The fracturing seal chamber 24 is sized to permit a well servicing tool, such as a fracturing isolation tool (not shown) to be run in, and preferably to be sealed against the central bore 20. The fracturing seal chamber 24 seals off and protects the top of the casing adapter 10, and thus the wellhead, from potentially damaging high pressure fracturing fluids. Side ports 31 may be provided through the adapter body 18 into the fracturing seal chamber 24, to provide access to the casing 12. These ports 31 may be sealed in any manner such as with the studded connection 31*a* for a gate valve (not shown).

The barrier seal chamber 26 has a profile which is sized to provide full bore access to the casing pipe 12 located therebelow, and to accommodate a removable pressure barrier such as a threaded, latched or snap ring type check valve or plug. FIG. 5 shows the barrier as a back pressure valve 32. In FIG. 5, the exemplary back pressure valve 32 is shown as a threaded one-way type H valve, so the profile of the valve seal chamber 26 includes a threaded valve portion 34.

Alternate check valves or plugs may be used to control the well pressure as is known in the industry, in which case the profile of the valve seal chamber 26 can be changed accordingly. As shown in FIG. 1, the valve seal chamber 26 may include, at its lower end, inwardly tapered sections 34*a* and 34*b* to accommodate the back pressure valve 32, and a narrowed bit guide section 34*c*. The fracturing isolation tool may use one of these narrowed sections such as 34*a* or 34*b* as a stop shoulder. As indicated above, the fracturing seal chamber 24 may alternatively be located below the barrier seal chamber 26, in which case the fracturing isolation tool could seal with sections 34*a* or 34*b*.

The casing adapter 10 is optionally, but preferably formed with an integral tubing hanger portion 36 at its upper end. The tubing hanger portion 36 has a central bore 20*a* which communicates directly with the bore 20 of the adapter body 18 so as to permit the fracturing isolation tool (not shown) to be run there through. The central bore 20*a* in the tubing hanger portion 36 has a profile to form a tubing hanger chamber 37 for sealing relationship with a tubing hanger 38 (see FIG. 5), which may be standard in the industry. The tubing hanger 38 carries seals 40 to seal to the central bore 20*a*, and preferably includes a second pressure barrier such as a check valve. FIG. 5 shows this barrier as a threaded back pressure valve 42. Other removable pressure barriers such as a threaded, latched or snap ring type check valve or plug may be used. Lockscrews 44 hold the tubing hanger 38 against upward displacement.

The provision of two removable pressure barriers is a preferred advantageous feature of the present invention. The casing adapter tool 10 can thus be formed with a profile at its upper end to accommodate a tubing hanger equipped with a barrier. Thus, the tubing hanger chamber 37 is sized for a blow out preventor (BOP) stack, i.e., for removal through the BOP stack. The profile for the lower barrier, that is the barrier seal chamber 26 can then be sized to match the casing, that is to provide for full bore access to casing.

The removable back pressure valves 32 and 42, as indicated above are only exemplary of suitable barriers against wellhead back pressure. Solid plugs may also be used. Various tubing hanger designs are known which include a back pressure valve or plug. Basically any removable pressure barrier which is of a threaded, latched or snap ring type check valve or plug, may be chosen, and the profile of the barrier seal chamber 26 is adjusted accordingly. The barriers are preferably designed to allow for pressure equalization across the barrier during installation. A check valve is a preferred barrier since it allows fluid to be pumped down for well control should this be required.

Figure 2:
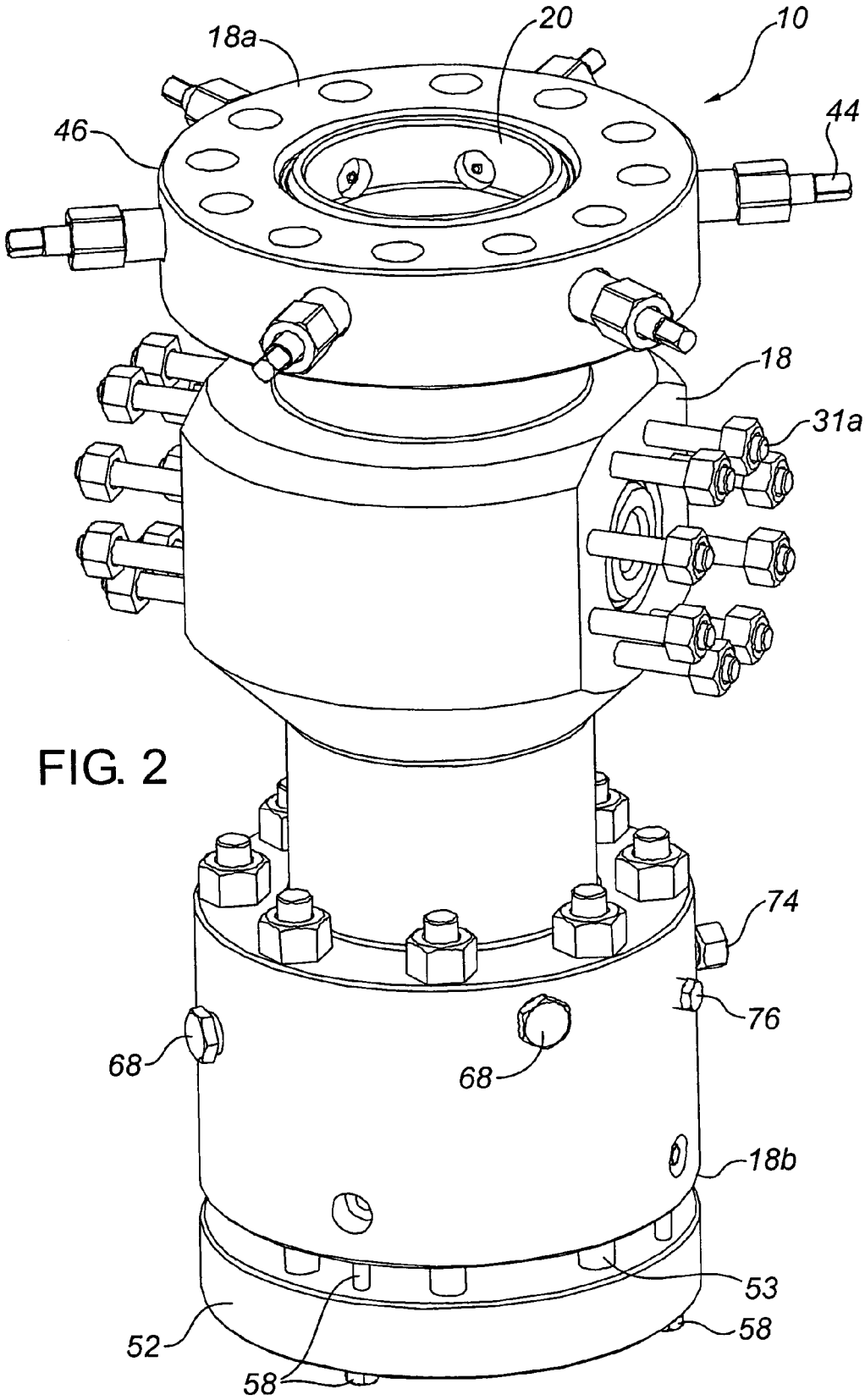
FIG. 2 is a perspective view of the casing adapter body of FIG. 1.

In FIGS. 1 and 2, the casing adapter 10 is shown to include a top flange 46, for the top connector to connect and seal to the production or service equipment (not shown) located thereabove. In FIGS. 6, 9, 12 and 15, which omit the tubing hanger portion 36, the top flange 46 is located directly above the barrier seal chamber 26. In FIGS. 7, 10, 13 and 16, the top connector includes a threaded portion 47, which mates with appropriate production or service equipment. Alternatively, the top connector may be a clamp connection.

Figure 8:
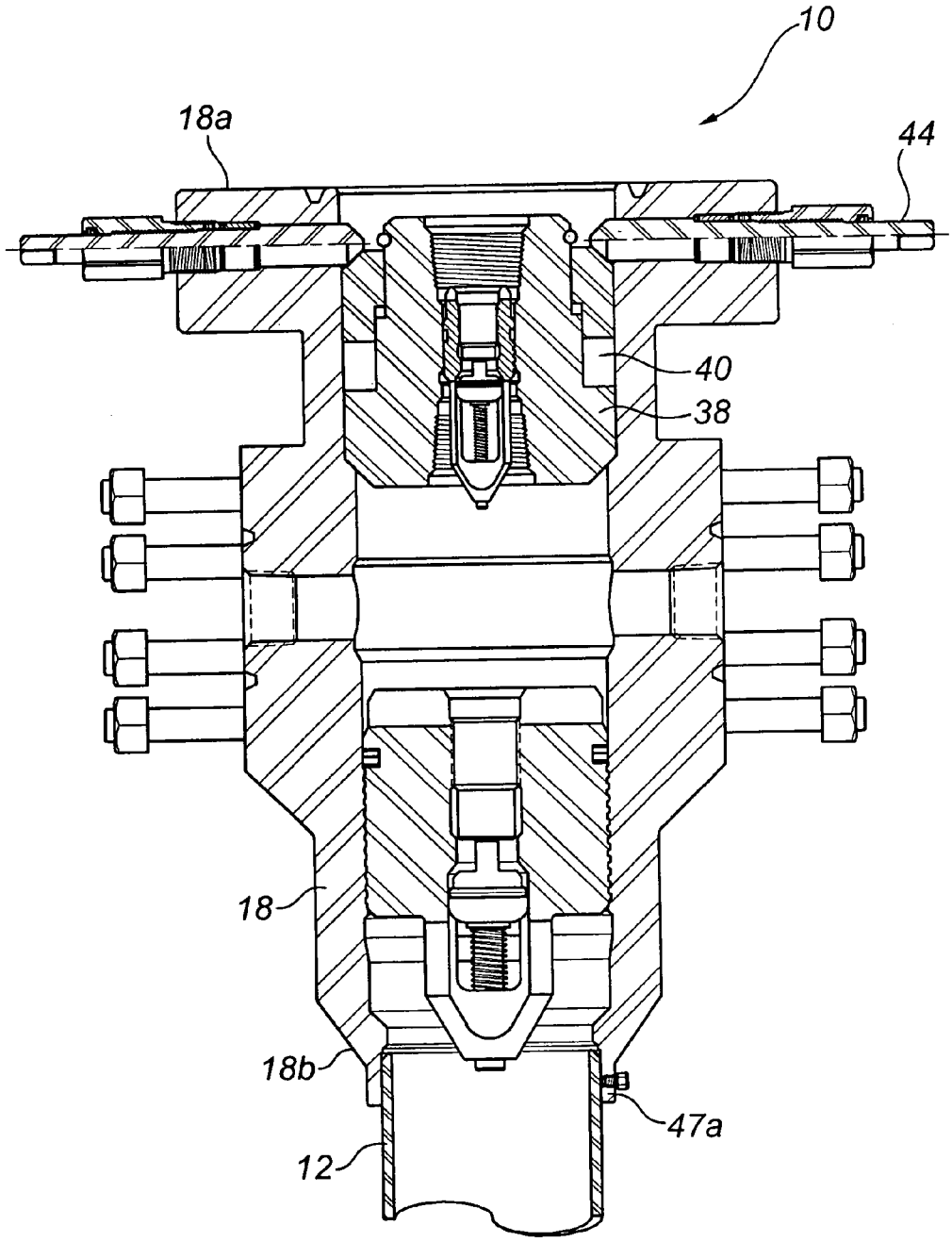
FIGS. 8, 9 and 10 all include welded connections at the lower end of the casing adapter tool to connect to the casing, and are as follows.
Figure 10:
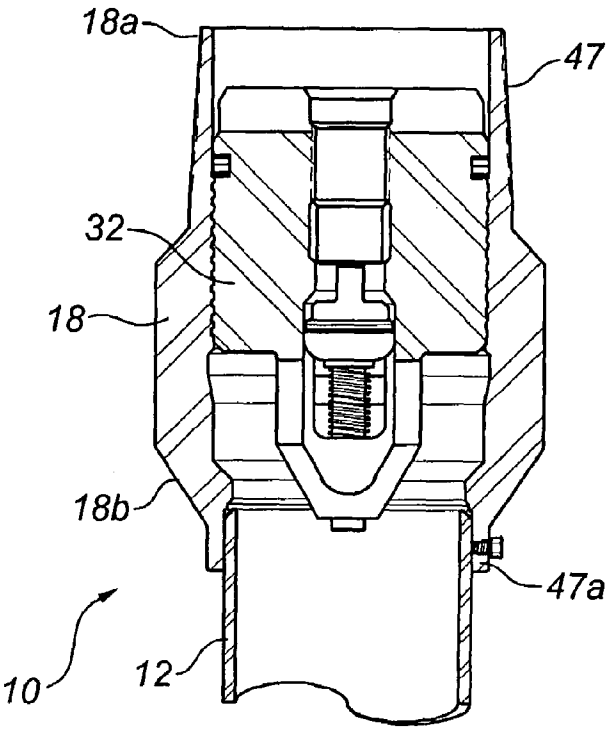
Figure 9:
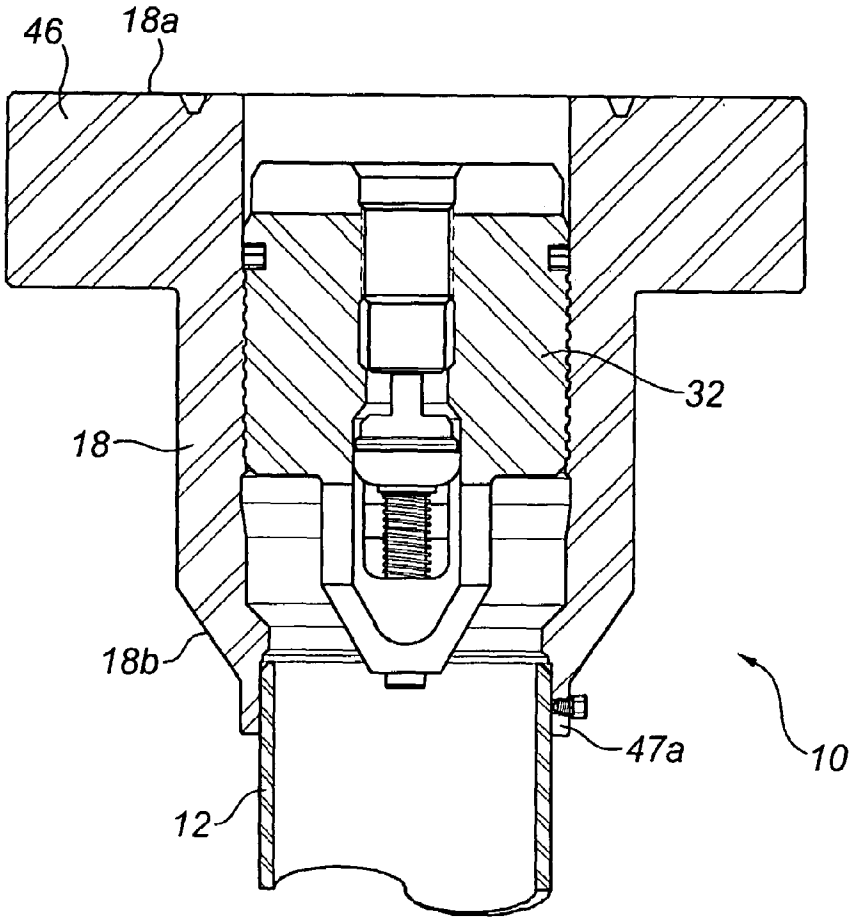
Figure 11:
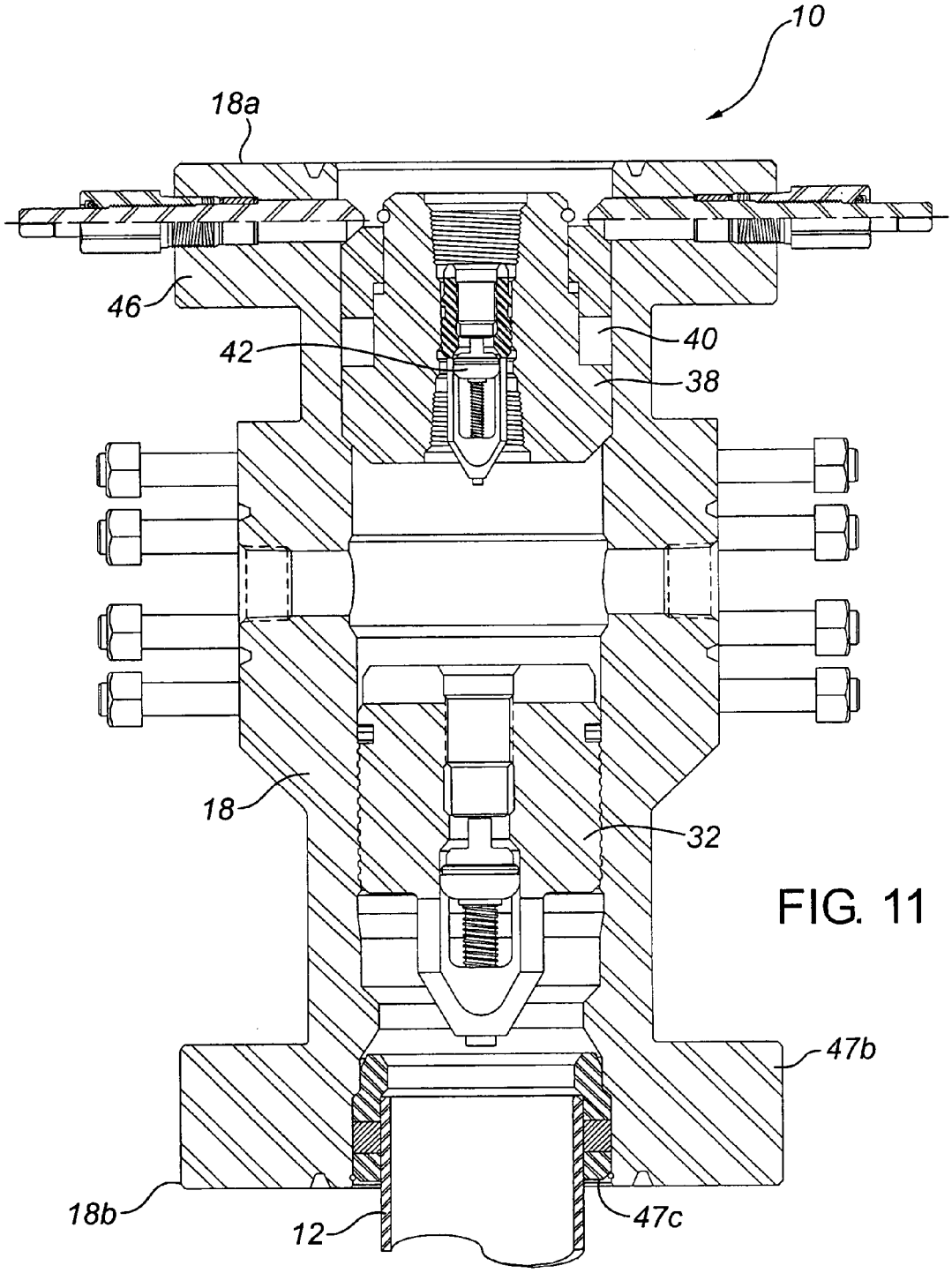
FIGS. 11, 12 and 13 all include flange connections at the lower end of the casing adapter to connect to the casing, and are as follows.
Figure 13:
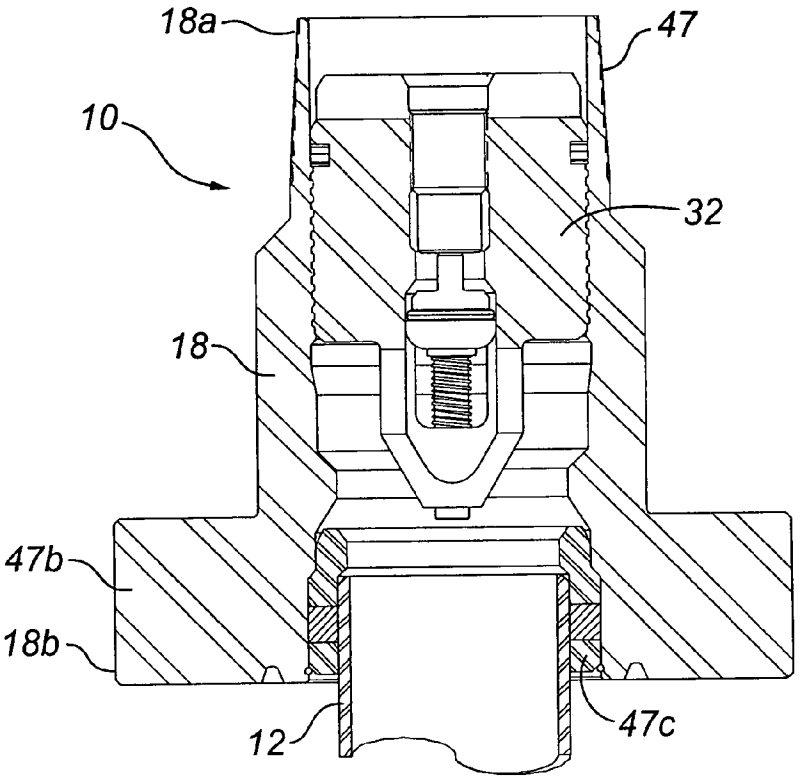
Figure 12:
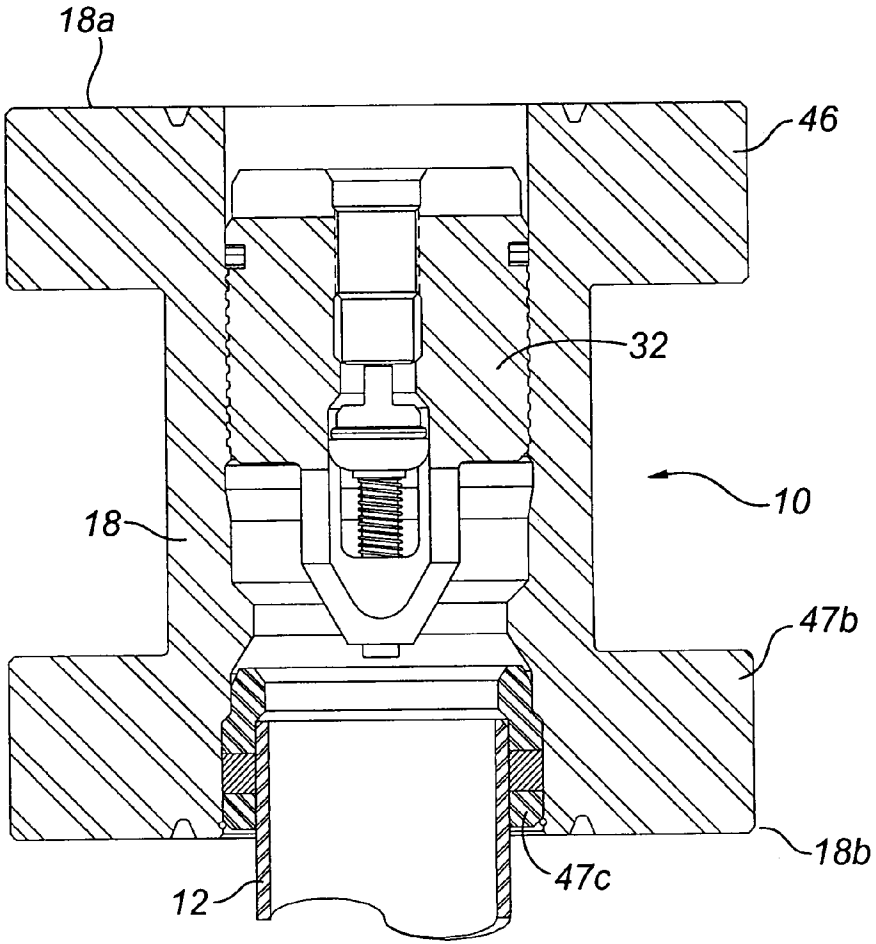
Figure 14:
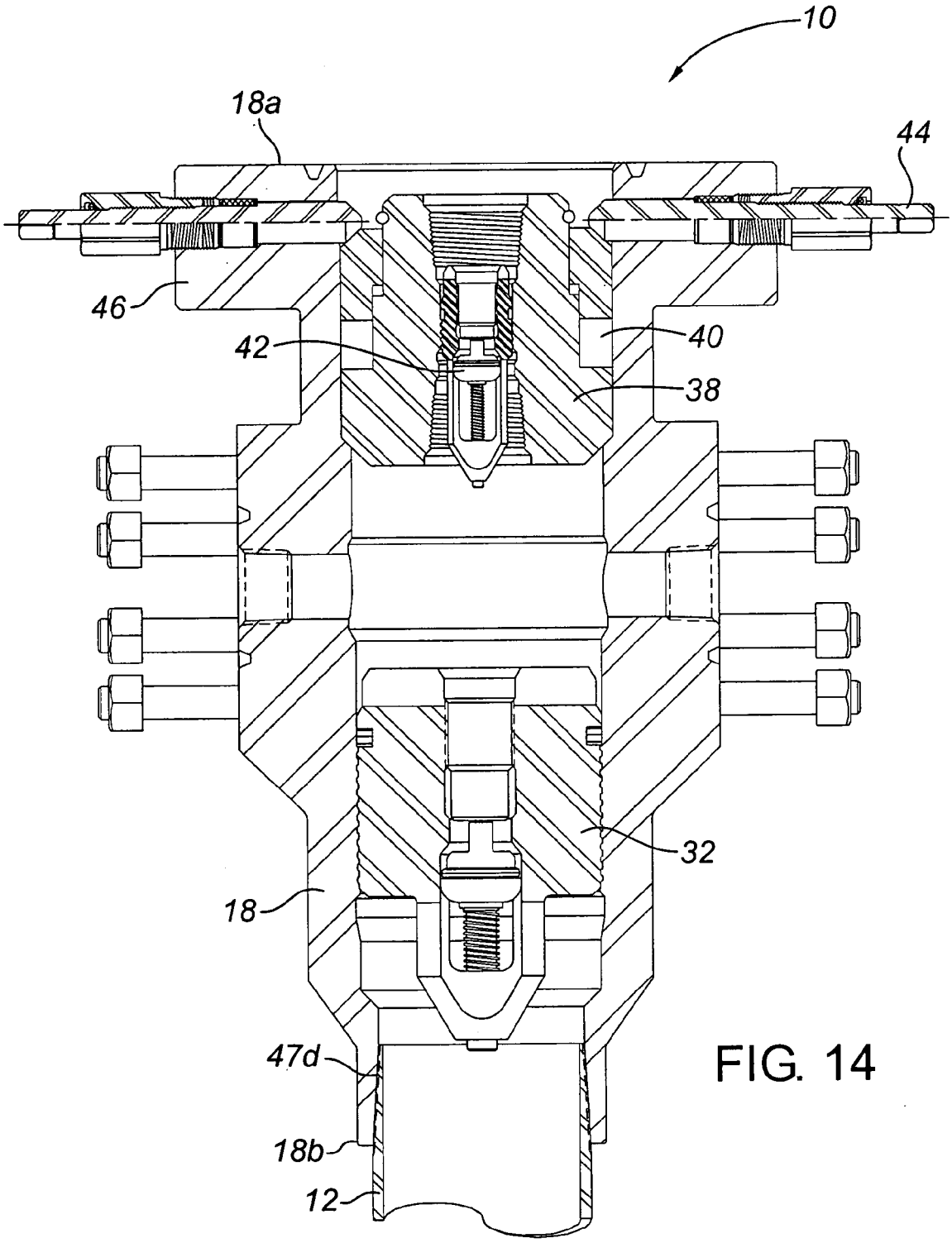
FIGS. 14, 15 and 16 all include threaded connections at the lower end of the casing adapter for connecting to the casing, and are as follows.
Figure 16:
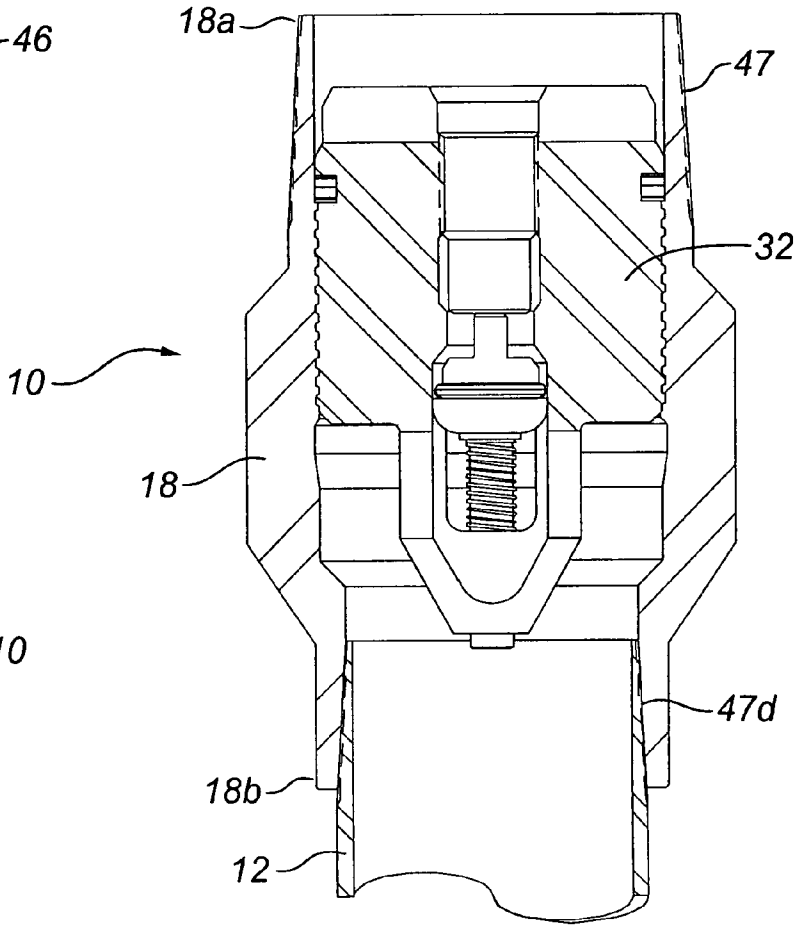
Figure 15:
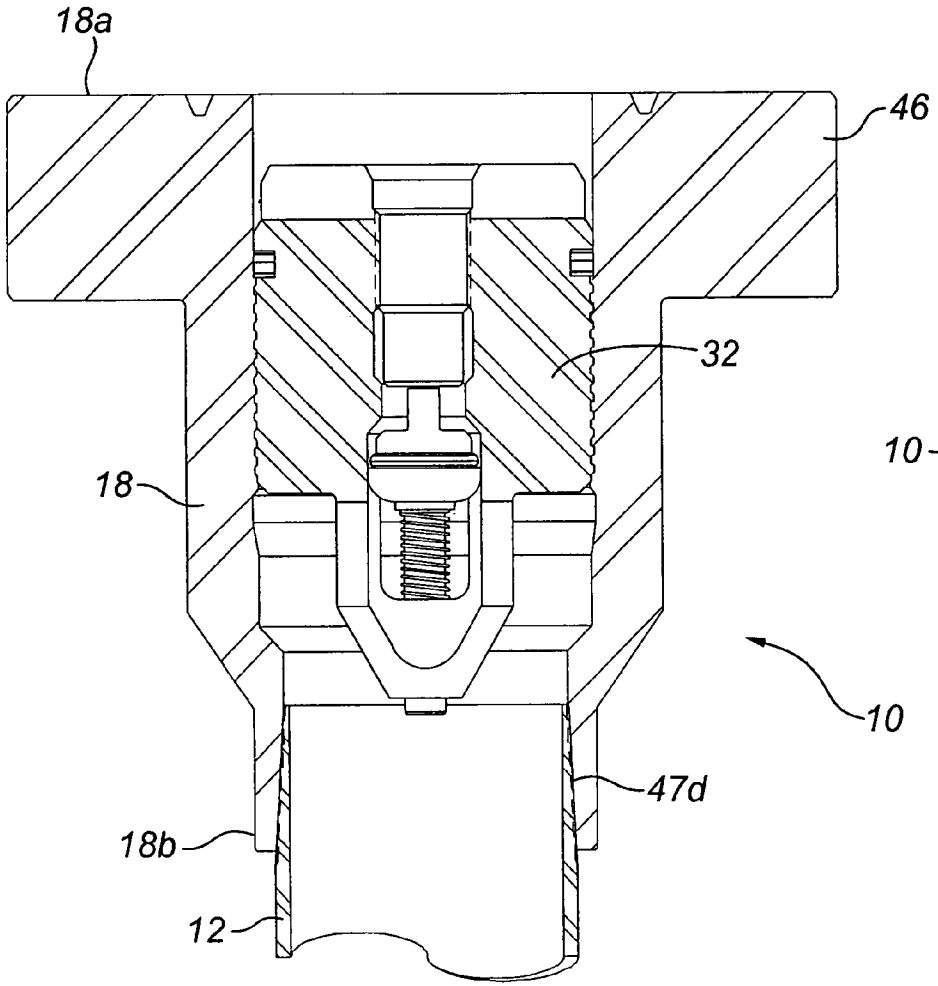

The bottom connector to the casing pipe 12 is shown in FIGS. 1, 2, 5, 6 and 7 to be a slip lock connection to the plain end surface-casing stub. As is known in the industry, slip lock connections using tapered slips may be used to mechanically engage to the casing pipe 12. The bottom connector to the outside wall of the casing pipe 12 holds the casing adapter 10 from upward motion due to internal pressure. Alternate bottom connectors include a welded connection 47*a* as shown in FIGS. 8, 9 and 10, or a bottom flange 47*b*, as shown in FIGS. 11, 12 and 13. The bottom flange connection might include bottom flange seal inserts 47*c* as shown in these Figures. A still further alternate bottom connection is shown in FIGS. 14, 15 and 16 to include a threaded portion 47*d*, which mates with threads on the casing pipe 12. Alternatively, the bottom connector may be a clamp connection.

The illustrated slip lock connection of FIGS. 1 and 5 includes a tapered slip set 48 (four in this embodiment) with teeth to grip the casing pipe 12, a reverse tapered slip sleeve 50, a retainer ring 52 which is separate from the adapter body and which rests on the conductor pipe (not shown), threaded studs 53 connecting the retainer ring 52 and the adapter body 18, nuts 54 which tighten on the studs 53 to draw the retainer ring 52 upwardly to engage the slip sleeve 50 and the slip set 48. The slip connection includes bolts 56 connecting the retainer ring 52 and the slip sleeve 50. Shipping bolts 58 are included to maintain the initial gap between the retainer ring 52 and the bottom of the adapter body before the slips are engaged. The slip lock connection also includes slip ring connecting lockscrews 60 which are inserted through the bores 61 to the slip sleeve 50 and the slip set 48. The lockscrews 60 seal in the bores 61 through rubber spacers 62 and washers 64.

Figure 4:
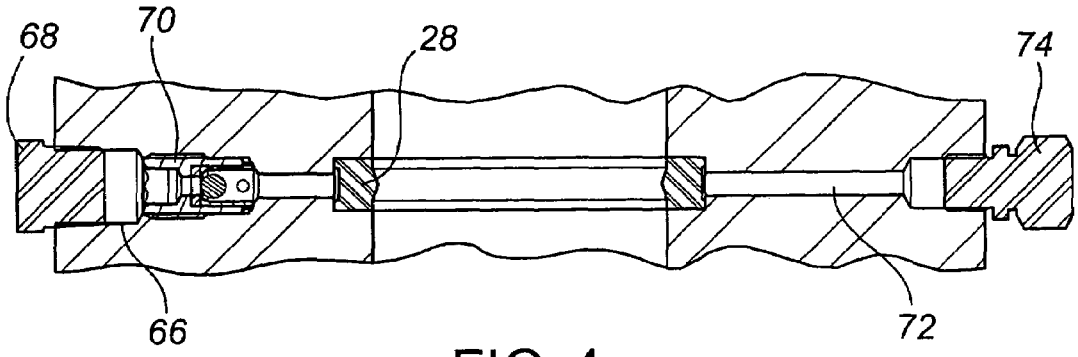
FIG. 4 is a partial, side sectional view of one of the seals for sealing the casing adapter tool to the casing pipe.

Sealing between the casing adapter 10 and the casing pipe 12 is preferably accomplished with built in secondary seals 28. The seals 28 may be energized by the injection of plastic through external ports in the casing adapter 10. Additional plastic may be added while the casing adapter 10 is in service. The seals 28 are shown in FIG. 4 with the fitting details, which include packing port 66 closed with packing plug 68 and equipped with a check valve 70, and packing bleeder port 72 closed with bleeder plug 74. A sealed test port 76 through to the casing seal chamber between the seals 28 may be provided to test the integrity of these seals 28.

Figure 3:
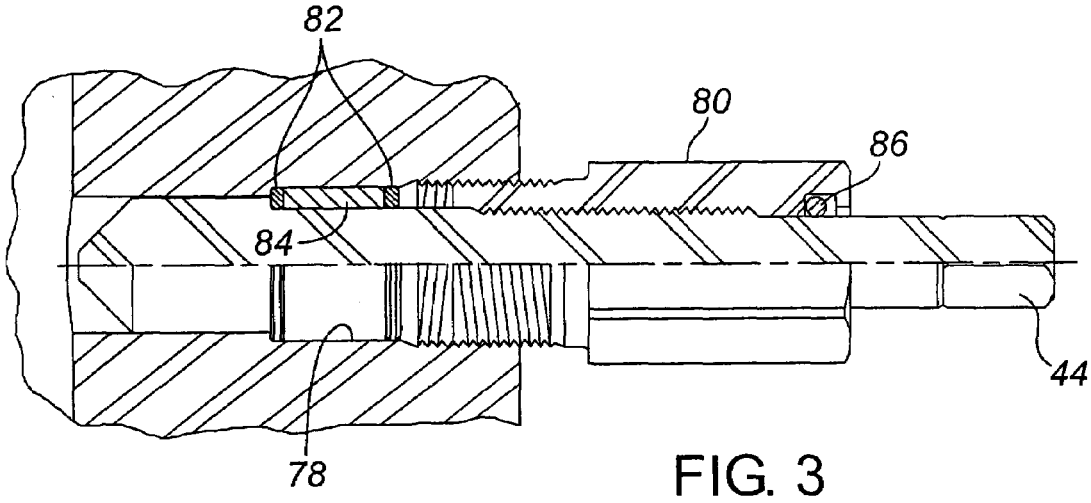
FIG. 3 is a partial, side sectional view of the lockscrew details, the lockscrew being located in the top flange of the casing adapter for retaining the tubing hanger (not shown in FIG. 1, see FIG. 5).

The details of each of the lockscrew retainers for the tubing hanger 38 are shown in FIG. 3 to include a lockscrew bore 78 (preferably six) through the top flange 46, lockscrew 44, lockscrew bushing 80, a pair of lockscrew flat washers 82, lockscrew packing 84, and lockscrew O-ring 86.

The casing adapter 10 provides a quick connection for fracturing equipment to the well. Once the fracturing is completed and all well servicing equipment is removed the casing adapter 10 remains on the well and provides at least one barrier (BPV 32) and preferably two independent barriers (BPV 32 and 42) between well bore pressure and atmosphere.

Other embodiments in FIGS. 6–16 show alternate top and/or bottom connections, and wherein the tubing hanger portion 36 is optional, are installed and used similarly, or as will be evident to those skilled in the art, having reference to the additional Figures.

All publications mentioned in this specification are indicative of the level of skill in the art of this invention. All publications are herein incorporated by reference to the same extent as if each publication was specifically and individually indicated to be incorporated by reference.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow.

We claim:

1. A casing adapter tool for connecting and sealing to a casing pipe at its lower end and to production or service equipment at its upper end, and for use with a well servicing equipment, comprising:

a generally tubular casing adapter body having an upper end and a lower end, said casing adapter body being formed with a central bore extending therethrough, the central bore providing a profile which forms a casing seal chamber at the lower end, a barrier seal chamber located thereabove, and a fracturing seal chamber above or below the barrier seal chamber;

lower connectors at the lower end of the casing adapter body for connecting and sealing to the casing pipe;

top connectors at the upper end of the casing adapter body for connecting and sealing to production or service equipment;

the barrier seal chamber:

having a profile to accommodate and seal to a first removable pressure barrier on removal of any well servicing equipment, and sized to provide full bore access to the casing pipe;

the first removable pressure barrier being a threaded, latched or snap ring type check valve or plug; and said fracturing seal chamber having a profile to permit a fracturing isolation tool to be run in and sealed against the central bore.

2. The casing adapter tool of claim 1, wherein the casing adapter body includes an integral tubing head portion at its upper end, which tubing head portion provides the top connectors at its upper end for connecting to the production or service equipment, the tubing head portion being formed with a central bore which communicates with the central bore of the casing adapter so as to permit a fracture tool to be run therethrough, the central bore in the tubing head portion forming a tubing hanger chamber for sealing relationship with a tubing hanger, and wherein the tubing hanger provides for installation of a second pressure barrier.

3. The casing adapter tool of claim 2, wherein the casing adapter body includes one or more sealed side ports between the tubing hanger chamber and the barrier seal chamber to provide for access to the casing pipe.

4. The casing adapter tool of claim 2, wherein:

the lower connectors to the casing pipe include a slip lock connector, a welded connection, a threaded connection, a flange connection, or a clamp connection;

the casing adapter body includes an inwardly extending stop shoulder formed at the top of the casing seal chamber in the central bore to protect the top of the casing pipe; and the top connectors to the production or service equipment include a threaded, flange or clamp connection.

5. The casing adapter tool of claim 1, wherein:

the lower connectors to the casing pipe include a slip lock connector, a welded connection, a threaded connection, a flange connection, or a clamp connection;

the casing adapter body includes an inwardly extending stop shoulder formed at the top of the casing seal chamber in the central bore to protect the top of the casing pipe; and the top connectors to the production or service equipment include a threaded, flange or clamp connection.

* * * * *